US007935881B2

(12) United States Patent
Aimi

(10) Patent No.: US 7,935,881 B2
(45) Date of Patent: May 3, 2011

(54) USER CONTROLS FOR SYNTHETIC DRUM SOUND GENERATOR THAT CONVOLVES RECORDED DRUM SOUNDS WITH DRUM STICK IMPACT SENSOR OUTPUT

(75) Inventor: Roberto M Aimi, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 11/973,724

(22) Filed: Oct. 10, 2007

(65) Prior Publication Data

US 2008/0034946 A1 Feb. 14, 2008

Related U.S. Application Data

(63) Continuation-in-part of application No. 11/196,815, filed on Aug. 3, 2005, now Pat. No. 7,772,481.

(51) Int. Cl.
*G10H 1/06* (2006.01)

(52) U.S. Cl. ..... 84/734; 84/610; 84/622; 84/625; 84/634; 84/650; 84/659; 84/660; 84/666; 84/723; 84/104; 84/411 R

(58) Field of Classification Search ..... None
See application file for complete search history.

(56) References Cited

U.S. PATENT DOCUMENTS

| | | | | |
|---|---|---|---|---|
| 5,062,341 | A * | 11/1991 | Reiling et al. | 84/702 |
| 5,920,026 | A * | 7/1999 | Yoshino et al. | 84/738 |
| 6,121,538 | A * | 9/2000 | Yoshino et al. | 84/738 |
| 6,271,458 | B1 * | 8/2001 | Yoshino et al. | 84/738 |
| 6,753,467 | B2 * | 6/2004 | Tanaka et al. | 84/723 |
| 7,381,885 | B2 * | 6/2008 | Arimoto | 84/737 |
| 7,385,135 | B2 * | 6/2008 | Yoshino et al. | 84/738 |
| 2003/0061932 | A1 * | 4/2003 | Tanaka et al. | 84/734 |
| 2004/0083873 | A1 * | 5/2004 | Yoshino et al. | 84/107 |

* cited by examiner

*Primary Examiner* — Marlon T Fletcher

(57) ABSTRACT

Methods and apparatus for simulating the sound of a specific percussion instrument. A first stored waveform representative of the impulse response of the specific percussion instrument is convolved with a second waveform representing of the vibrations produced when a playing surface is struck, scraped or rubbed by a hand-held implement manipulated by a human player. A control interface produces a control signal indicative of a desired audio effect, and a signal processor modifies the spectral components of the output waveform produced by the convolution in response to the control signal to produce a modified output waveform that manifests the desired audio effect.

34 Claims, 5 Drawing Sheets

USER CONTROLS FOR SYNTHETIC DRUM SOUND GENERATOR THAT CONVOLVES RECORDED DRUM SOUNDS WITH DRUM STICK IMPACT SENSOR OUTPUT

CROSS REFERENCE TO RELATED APPLICATION

This application is a continuation in part of, and claims the benefit of the filing date of, U.S. patent application Ser. No. 11/196,815 filed on Aug. 3, 2005 and published as U.S. Application Publication 2005/0257671, the disclosure of which is incorporated herein by reference.

FIELD OF THE INVENTION

This invention relates to an electronic percussion system that simulates the sound or behavior of an acoustic percussion instrument.

BACKGROUND OF THE INVENTION

Electronic counterparts have been developed for many different acoustic instruments. With the successful adoption of electronic keyboards and guitars, and the advent of a rich variety of synthetic devices implementing the MIDI (Musical Instrument Digital Interface) standard, electronic music instruments of many kinds are now in widespread use. An introduction to the techniques commonly used in the synthesis and transformation of sound and which form the basis of digital sound processing for music is presented in Digital Sound Processing for Music and Multimedia by Ross Kirk and Andy Hunt, Focal Press (1999), ISBN: 0240515064.

Conventional electronic percussion instruments typically employ a sensor as illustrated at 101 in FIG. 1 that is acoustically coupled to a drum or drum-like striking surface 103 for producing a timing signal that is processed by a triggerable digital direct-sound module 105. The timing signal may also be created by attaching a pickup device called a "drum trigger" to an existing acoustic drum. A drum trigger or other sensor typically employs a pressure responsive piezoelectric transducer coupled to an amplifier and peak detector for producing trigger signals that indicate the timing and intensity of drum stick strikes on the surface of the drum. Commercially available "drum kits," such as the hi-hat electronic drum taught in Yamaha's U.S. Pat. No. 6,815,604, employ striking pads which simulate acoustic drumheads and other percussion instruments and employ striking surfaces that are struck with sticks (or striking rods). Striking intensities are detected by impact sensors such as piezoelectric transducers connected to the pads. The triggerable direct sound module 105 responds to each trigger signal by delivering an output signal to a conventional mixer and amplifier 107 connected to one or more loudspeakers 109. The output waveform produced by each striking event simulates, or is a recording of, the sound produced by the instrument being simulated. Triggerable direct sound modules are available from major manufactures such as Alesis, Roland, Yamaha and Kat.

In MIDI music systems, drum and other percussion sounds are simulated in response to a variety of trigger events, including keyboard events or drum pickups, which are converted into digital event signals conforming to the MIDI standard by a MIDI interface. A MIDI controllable sound module then produces digitized synthetic sound signals. A more thorough description of an electronic percussion instrument of the type shown in FIG. 1 is presented in U.S. Pat. No. 5,293,000 issued to Alfonso Adinolfi on Mar. 8, 1994 entitled "Electronic Percussion System Simulating Play and Response of Acoustical Drum," the disclosure of which is incorporated herein by reference.

The sound produced by both acoustic and synthetic instruments can be modified and enhanced to achieve special effects by a technique called "convolution." Convolution, the integration of the product of two functions over a range of time offsets, and is a well known technique for processing sound. If an input sound signal is convolved with the impulse response of system (for example, the impulse response may represent the acoustic response of a particular orchestra hall), the signal produced by the convolution simulates the result that would occur if that sound signal had passed through a physical system with the same impulse response. Convolution has many known musical applications, including forms of spectral and rhythmic hybriding, reverberation and echo, spatial simulation and positioning, excitation/resonance modeling, and attack and time smearing.

The use of convolution in musical sound processing is described in the paper "Musical Sound Transformation by Convolution" by C. Roads, Proceedings of the International Computer Music Conference 1993, Waseda University, Tokyo. That paper contained an explanation of the theory and mathematics of convolution and included a survey of compositional applications of the technique as a tool for sound shaping and sound transformation. More recently, Roads described the uses of convolution in his book, The Computer Music Tutorial, MIT Press, 1996, pages 419-432 of which are devoted to convolution. Convolution has been used to create synthetic drum sounds.

Libraries of recordings of different acoustic drum sounds, recorded in an anechoic room, that can be triggered, for example, by a MIDI keyboard, are available. Many different versions of the same drum sounds are created by convolving the recorded drum sounds with different recorded impulse responses exhibited by different rooms, or taken with different microphone locations in the room. The selection and combination of different drum sounds and different room characteristics as well as different microphone and instrument locations can be accomplished using available sound production software that includes the ability to convolve recorded sounds with the impulse response of different environments. See, for example, Larry Seyer Acoustic Drums for the GIGASTUDIO 3.0, Larry Seyer Productions, 2004.

All of the synthetic percussion instruments described above employ the same basic principle and suffer from a common disadvantage. Each sound or each simulated drum impact is initiated by a sensed or MIDI trigger event, indicating the timing and intensity of a drums stick impact or striking a key on a keyboard. When a striking surface is used, the output from the piezoelectric sensors is processed by peak detection to identify the trigger events. Thus, most of the information content of the signal from the impact sensor is largely discarded and only the event timing and intensity information is extracted to initiate the playback of a stored impact response.

As an example, U.S. Pat. No. 4,939,471 issued to Werrbach on Jul. 3, 1990 entitled "Impulse detection circuit" describes a triggering circuit for detecting drum beats within background noise and then triggering music synthesizers in response to the drum beat. As described in the Werrbach patent, differentiators, peak-rectifiers and filters are used to detect impulse like inputs over a wide dynamic range in a noisy background. The input signal is rectified and differentiated and then passed through a peak-rectifier and filter having a fast charging and a slow discharging time constant. The response of such triggering circuits is intentionally made highly-nonlinear in order to extract the only timing of substantial impacts on a drum pad surface, rejecting all other signals as being unwanted noise. As a result, the performer loses the ability to create and control many of the sounds and subtle effects that can be created with an acoustic instrument.

SUMMARY OF THE INVENTION

It is an object of the present invention to make more realistic digital instruments whose behavior is similar to that of real instruments.

In its preferred embodiment, the invention simulates the sound, behavior or both of real instruments by joining real-time convolution algorithms with semi-acoustic physical objects, sensors, and mappings that can change the apparent acoustics of the objects.

It is an object of the present invention to produce synthetic percussion sounds by a process that more accurately replicates nuance and variation of sound produced by an acoustic percussion instrument and that preserves the percussionist's ability to create sounds like those created with an acoustic instrument using the same performance techniques used with an acoustic instrument.

The preferred embodiment of present invention takes the form of an electronic percussion instrument that simulates the sound and playing dynamics of a particular existing instrument. To play the instrument, the performer strikes, scrapes or rubs the playing surface of an object. A sensor acoustically coupled to the object produces a signal waveform representative of the forces impacting the object. A second waveform representing the recorded response of the existing instrument to a single impact is convolved with the waveform representing the playing impacts; that is, the product of the first and second waveforms are integrated in, real time to form an output signal which represents the desired output sound. The instrument further includes a control interface that accepts control signals provided by the performer. For example, the performer may produce the sound of a damped instrument by touching the playing surface, or may adjust a control to vary the pitch of the output sound. The resulting sound replicates the sound that would have been produced had the unique time series of striking or rubbing forces which impacted the object playing surface instead had impacted the acoustic instrument.

In its preferred embodiments, the invention allows players to apply their intuitions and expectations about real acoustic objects to new percussion instruments that are grounded in real acoustics, but can extend beyond what is possible in the purely physical domain.

In accordance with one feature of the invention, extensions to the functionality of convolution algorithms are employed to accommodate damping, muting, pitch shifts, and nonlinear effects, and a range of semi-acoustic physical controllers can be integrated with the system architecture to permit the player to control the behavior of the instrument.

Electronic percussion instruments using the invention preferably employ a signal processor to vary the manner in which the output signal is produced in response to variations in the control signals accepted from the performer. An input filter responsive to one or more of such control signals may be employed for modifying the signal waveform produced by the impact sensor before it is convolved with one or more stored impulse responses. The signal processor may also modify the output waveform produced by the convolution process before it is reproduced by the output sound system.

The performer may selectively control the manner and extent to which the sounds produced are damped. The signal processor may progressively decrease the magnitude of components of the output waveform resulting from each impact to emulate the behavior of a damped instrument, and control the extent of damping in response to a control signal produced when the performer touches the playing surface.

In order to achieve high speed processing with minimum latency, a memory device preferably stores a plurality of frequency domain (FD) representations of a sequence of consecutive segments of a impulse response. In this arrangement, damping is achieved by progressively reducing the magnitude of the time domain input output waveform before it is transformed into the frequency domain and multiplied by each of these FD representations, or by reducing the magnitude of the time domain output waveform produced by inverse frequency transform after this multiplication step.

The memory device may store waveform data representative of the sound produced by a particular instrument under different conditions or by different instruments, and the signal processor may perform one or more convolutions to produced an output waveform which blends or switches between the different stored sounds. For example, one stored sound may represent the sound produced by a ride cymbal and a second stored sound may represent the sound produced by a crash cymbal. The processor can then perform a first convolution process using a stored ride cymbal sound for low amplitude impacts, and perform a second convolution with the crash cymbal sound for impacts above a threshold amplitude.

The object which defines the playing surface may be an actual percussion instrument or may simulate the playing experience of an actual percussion instrument. When the object is formed from an actual cymbal, a second sensor coupled to the cymbal's surface may generate a first control signal when the surface of said cymbal is touched, and this signal may be used to control damping. A variable control, such as potentiometer, may also be positioned at the top of a cymbal and adjusted to alter the pitch of the output sound. When the instrument is implemented as an actual or simulated drum, a loudspeaker may be housed within the drum to produce the synthesized drum sounds.

These and other objects, features and advantages of the invention may be better understood by considering the following detailed description of specific embodiments of the invention.

BRIEF DESCRIPTION OF THE DRAWINGS

In the detailed description which follows, frequent reference will be made to the attached drawings, in which.

DETAILED DESCRIPTION

Figure 2:
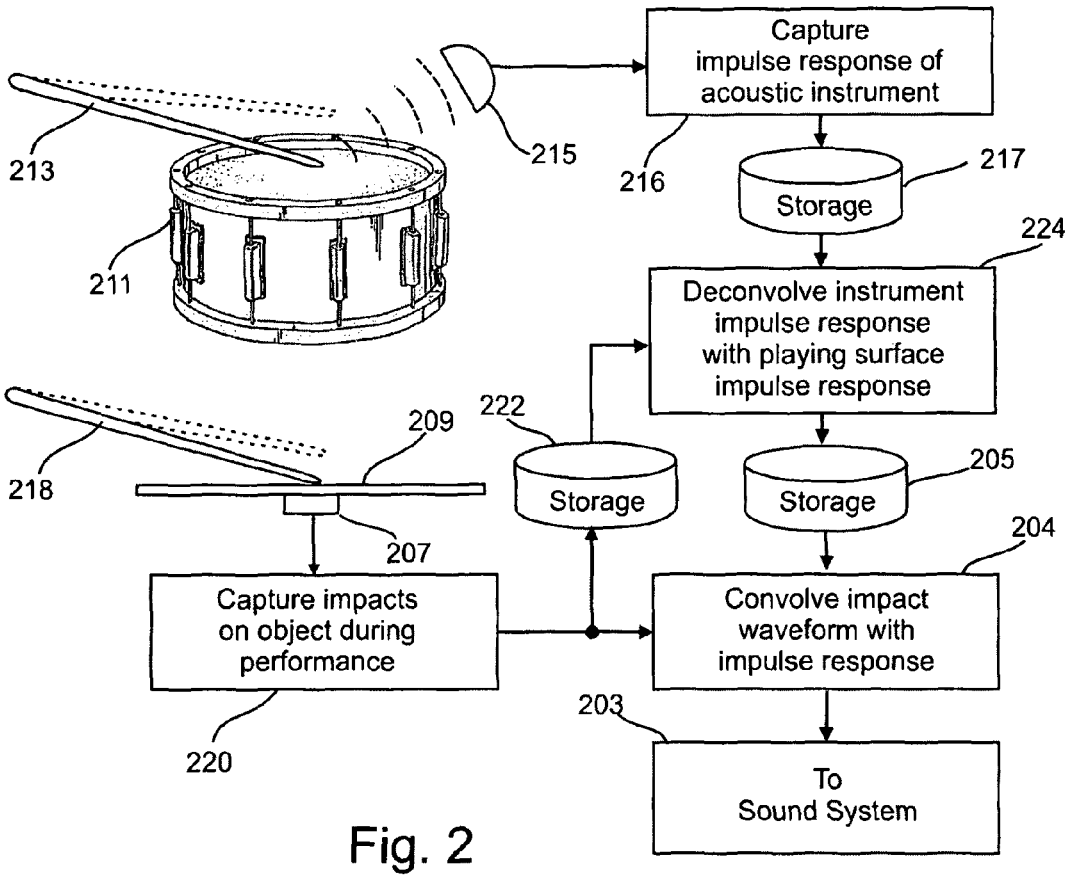
FIG. 2 is a schematic block diagram illustrating an electronic percussion synthesizer employing the invention.

The description that follows will first explain the basic mechanism for synthesizing a percussion instrument as described in my above-noted U.S. Application Publication 2005/0257671 and shown in FIG. 2, followed by an explanation of modifications and enhancements that may be made to that basic mechanism in order to produced desired special effects, such as producing the sounds made by damped instruments, crashed cymbals, and other special effects.

Overview

The preferred embodiment of the invention simulates sounds produced by a real percussion instrument. It includes a memory unit for storing a first signal waveform representative of the sound produced by the real percussion instrument when it is impacted by a momentary striking force. A human performer manipulates a hand-held implement such as a drum stick, mallet or brush to repetitively strike, scrape or rub a playing surface. A sensor acoustically coupled to the playing surface produces a second signal waveform representative of the vibration of the playing surface when it is struck, scraped or rubbed. A controller produces a control signal that is indicative of a desired audio effect, and a signal processor convolves representations of the first signal waveform and the second signal waveform to produce an output waveform and responds to the control signal for modify the output waveform so that it manifests the desired audio effect.

The signal processor may modify the rate of decay manifested by the output waveform to simulate a damped instrument, and/or it may modify the amount of relative energy contained in different spectral bands of the output waveform to alter the apparent pitch of the output waveform.

One or more manual controls manipulatable by the performer may be used to vary the damping or the pitch of the output waveform. A damping control may be implemented by an additional sensor or sensors coupled to the playing surface for determining whether or not, or the extent to which, the performer touches the surface, thereby simulating the behavior of real instruments such as cymbals which may be damped by touching the instrument. A pitch control, which may take the form of a control knob positioned at the top of a cymbal or hi-hat, may be manipulated by the performer to vary the pitch or timbre of the sound produced. Other controls, such as foot pedals, knobs, sliders, or software-controls presented by a graphical user interface, may be employed to vary the control signal that specifies a desired audio effect.

To more efficiently convolve the stored impulse response waveform or waveforms with the waveform representing the vibration of the playing surface as it is struck, scraped or rubbed, at least a portion of the impulse response waveform may be subdividing into consecutive segments of increasing size. A frequency domain representation of each of the segments is stored in the memory unit. A frequency domain representation of the waveform produced by the playing surface during a performance may then be multiplied by the stored FD signals and the resulting product data may processed by a FD to time-domain transform such as an Inverse Fast Fourier Transformation to produce the output waveform. In order to modify the output waveform so that it manifests a desired audio effect, the signal processor may separately modify the each of the segments in response to the control signal, either by modifying the stored segments in the time domain or in the frequency domain, by modifying the performance waveform from the playing surface, or by modifying the output waveform in the frequency domain or in the time domain. Each of the segments may be modified in different ways or in the same way, depending on the audio effect desired. The segments may be filtered before their FD representations are stored, or may be filtered after the convolution is performed. The amount of relative energy contained in different spectral bands of the output waveform may be modified to alter the apparent pitch of the output waveform. The signal processor may rotate or stretch the spectrum of the stored impulse response waveform(s), the waveform produced by the playing surface during a performance, or of the output waveform in the frequency domain to alter the pitch of the output waveform.

Convolving Impact Signals with the Stored Impulse Response of the Instrument being Synthesized The embodiments of the invention described below allow a percussionist to make sounds that can not be made with current electronic drum technology. Light brushes, scrapes, and the timbres of the hits on an acoustic instrument are important elements of a percussionist's performance but are often ignored by conventional synthetic percussion devices. Embodiments of the present invention allow a percussionist to "play" a physical object, and the impact forces acting on the object are sensed by a direct contact transducer and processed to create a resulting sound as if the percussionist had played a selected acoustic instrument with the same gestures. For example, the player could play a drum pad with a drum brush, and sensed signal from the pad may be processed to sound like a brush against a cymbal. Brighter hits result in brighter sounds, and small taps and scrapes on the sensing surface sound like the same taps and scrapes played on a cymbal.

As illustrated in FIG. 2, the preferred embodiment of the invention forms an output signal delivered to a sound system 203 by employing a signal processor to perform the step shown at 204 of convolving waveform data stored at 205 with a waveform captured by a transducer 207 that senses the forces impacting a physical object 209 that defines a playing surface. The sound system to which the output signal is delivered as indicated at 203 may produce output sounds immediately via one or more loudspeakers, headsets, or the like, may transmit the output signals to another location, or may record the signals for future playback or further processing.

The waveform data stored at 205 represents the impulse response of an acoustic percussion instrument and its surroundings as illustrated at 211. The stored impulse response may be produced and stored by recording the sound produced when the instrument 211 is tapped once using a stick 213. A microphone 215 captures the sound from the instrument 211 which is then amplified and digitized by conventional means (using a sampling circuit in combination with an analog-to-digital converter) as indicated at 216 to produce stored digital waveform data that is stored at 217 for further processing at 224 (explained below) before it is persistently stored at 205. The data stored at 205, which may be compressed in conventional ways, represents a series of amplitudes of the sound waveform from the microphone 215 taken at a sampling rate of at least twice the highest frequency to be replicated in the resulting sound. The sampling rate used should match the rate at which the vibratory signal from the transducer 207 is taken. A sampling rate of 44,100 samples per second, the rate at which CD's are encoded, can reproduce frequencies up to 22,050 Hz, well above the 20,000 Hz limit of human hearing.

The impact that produces the impulse response waveform stored at 205 should ideally be an impulse; that is, should be a force that has a very short duration. The idealized impulse has zero duration and infinite amplitude, but contains a finite amount of energy. In the context of the present invention, the impulse force that is applied to an acoustical instrument in order to capture its characteristics should be as short as possible, and may be applied by a single impact from a drumstick or similar sharp impact.

Figure 1:
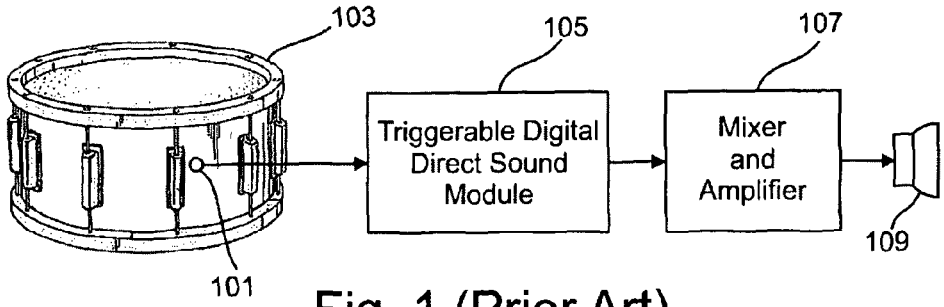
Fig. 1 (Prior Art)
FIG. 1 is schematic block diagram of a conventional electronic percussion instrument.

A rich variety of waveforms representing many different instruments may be recorded in different ways in different environments and placed in the storage device 205; for example, snare drums played in a small room, or kettle drums played in an orchestra hall, with different microphone placement in each case. Libraries of "impulse response" data for many different environments are available commercially for use with triggerable digital direct sound modules of the type described above in connection with FIG. 1, such as the libraries available from Larry Seyer Productions noted above. Note that, in the general case, the waveform data stored at 205 represents not only the impulse response of a particular acoustic instrument but the combined responses of both the instrument and the acoustic environment in which is played as sensed at the microphone 215. Alternatively, different recording environments and conditions (e.g. different locations of the microphone) may be simulated by convolving a recording of the instrument with the impulse response of a particular environment. As a consequence, multiple impulse responses may be stored at 205, and the performer may choose a particular impulse response to select the type of acoustic instrument and acoustic environment desired for a particular performance.

The transducer 207 is preferably a piezoelectric device placed in direct contact with an object 209 that defines a playing surface and the resulting waveform from the transducer 207 is a linear representation of vibrational forces due to impact, scrapping and/or rubbing forces applied to the surface when the object 209 is played as illustrated by the stick 217 striking the object 209. The object 209 may be any object which, in combination with the transducer 207, captures the tapping, scrapping or rubbing vibrations imparted by the performer. If desired, the object 209, and transducer 207 may be one of many such pickup devices such as a commercially available drum pad. Multiple striking surfaces and transducers may be arranged around the player and form a drum set, with the output from each drum pad potentially being convolved with a different impulse response to obtain a different sound from each pad. Multiple sensors may be attached at different positions on the same pad, with each transducer output being processed using a different impulse response. An example of such a drum set is disclosed in U.S. Pat. No. 6,815,604 issued to Jiro Toda (Yamaha Corporation) issued on Nov. 9, 2004 and entitled "Electronic Percussion Instrument," the disclosure of which is incorporated herein by reference. The physical device may be an actual percussion instrument equipped with a suitable sensor, such as a clip-on piezoelectric transducer that can be attached to an acoustic instrument, or a simulated instrument as described in the above-noted Adinolfi U.S. Pat. No. 5,293,000. In all cases, the sensor and any associated amplification circuitry seen at 220 should produce an output signal which is a linear representation of the vibration within the object, rather than supplying a triggering or timing signal of the type used in conventional electronic drum simulation systems.

Compensating for Unwanted Responses

In some cases, the physical object 209 may have unwanted resonances or other undesired acoustic qualities. These undesired characteristics may not be objectionable when the pickup is used solely to produce timed trigger signals, but when it is desired to produce a linear representation of the vibrations imparted to the surface during play, it is desirable to compensate for these effects. This may be done by preprocessing the waveforms stored at 205 as indicated at 224 by filtering to remove unwanted resonances with the transducer 207 and object 209. This filtering may accomplished by deconvolving each waveform stored at 217 as indicated at 224 before the waveform is placed in the storage unit 205. The waveform from 217 is deconvolved with the impulse response of the physical object 209 and sensor 207. This, in effect, cancels out any unwanted response characteristics that might otherwise be created by the physical object and permits invention to be implemented by a wide range of playing surfaces. Note that the acoustic instrument waveform(s) stored at 217 are obtained by recording the output from an acoustic instrument, and may be obtained from an available library of waveforms from an available source. The waveforms in the store 217 are independent of the performance instrument. The processing that takes place at 224 however is a special filtering operation that compensates for the behavior of the physical playback instrument (physical object 209 and transducer 207).

To perform this filtering function at 224, the physical object is hit with a momentary impacts and its impulse response is captured at the output of 220 and placed in the storage device 222. Each impulse response captured from an acoustic device as stored at 217 is then deconvolved at 224 with the impulse response of the physical playing object (e.g. a drum pad) 209. The deconvolution may be performed before the impulse response waveform from the acoustic instrument is placed in the store 205 as shown in FIG. 2. Alternatively, the impulse response stored at 222 may be deconvolved with the captured impact waveform at the output of 220 in real time. This, in effect, removes the effects contributed by the response of the physical object 209 and the transducer 207 and creates an accurate representation of the impact forces applied to the surface of object 209 during a performance. However, this real time filtering of the output from the transducer 207 places an additional computational burden on the processor at performance time, whereas deconvolving the stored acoustic instrument waveforms in advance need be performed only once on the smaller instrument impulse response files. Other inverse filtering methods can also be utilized. For example, it is possible to derive filter parameters from the recorded impact 220 to control a graphic equalizer or other filter.

Note also that a switching or mixing system may be used to switch between or convolve two or more different stored waveforms with the impact signal from the transducer 207. For example, simple damping may be implemented by running two convolutions at once, one of a damped target sound, and the other of an undamped sound. A sensor may then be used to detect if the player's hand is touching the playing surface and crossfade to the damped sound if it is. Thus, if the player hits the playing surface normally, it "rings" in accordance with the undamped waveform, or if the player hits and then holds the playing surface, the output sound is damped.

Convolution and Deconvolution

The waveform data that is representative of a desired sound, such as a recording of the impulse response of a particular acoustic instrument located in a desired acoustic environment, is convolved with the output of the transducer 204 by the processor 204 using a convolution algorithm. The terms "convolve" and "convolution" as used herein refer to a signal processing operation consisting of the integration of the product of waveform signals that vary over time. Convolution in the time domain is equivalent to multiplication in the frequency domain and is a powerful, commonly used and well known digital signal processing technique described, for example, in Chapter 6 of "The Scientist and Engineer's Guide to Digital Signal Processing" by Steven W. Smith, California Technical Publishing, ISBN 0-9660176-3-3 (1997). Convolution when performed in real time, as it is in the present invention, should be performed by an efficient digital algorithm, such as the accurate and efficient algorithm exhibiting low latency described in Gardner, W. G. (1995). Efficient convolution without input-output delay. J. Audio Eng. Soc. 43 (3), 127-136. and in U.S. Pat. No. 5,502,747 issued to David S. McGrath on Mar. 26, 1996 and in U.S. Pat. No. 6,574,649 issued to McGrath on Jun. 22 2001, the disclosures of which are incorporated herein by reference. The foregoing McGrath patents describe both time-domain convolution (using multiply and add operations) and frequency-domain convolution (using Fast Fourier Transform multiply operations), as well as zero latency methods that use direct convolution for the first part of the impulse response, and fast convolution for the remainder, with progressively larger windows. This approach allows true real-time low latency processing (limited by the audio hardware) with modest hardware requirements.

Convolution (represented by the symbol * of two functions x and y) performed numerically consists of integrating (summing) the products of two functions over a range of time offsets and may be defined as:

$$(x * y)_n \triangleq \sum_{m=0}^{N-1} x(m)y(n-m)$$

where N is the length of the signal y. If the response of a linear system to an impulse is known, the system's response to an arbitrary function may be obtained by convolving that function with the impulse response of the system. This technique is widely used to implement filters of known impulse response, and specialized digital signal processors (DSPs) have been designed to perform the necessary multiplication and summing quickly enough to achieve filtering in real time. Since this algorithm is of order NM (N is the length of signal x, M is the length of signal y), working with long impulse responses in the time domain can still be prohibitive.

The term "deconvolution" as used herein refers to any of several kinds of processes that remove or attempt to remove the effects of a transfer circuit having an known impulse response, or the effects of convolution of an input signal with a know impulse response. As discussed earlier, convolving an input signal with the impulse response of a transfer circuit produces the output signal that would be formed by passing that input signal through the transfer circuit. In the same way, deconvolving a given signal with the input response of a transfer circuit recreates the input signal that would have been applied to the transfer circuit in order to produce the given signal. Thus, deconvolving the output signal at the output of 220 with the impulse response of the striking surface and transducer 207 creates a waveform that represents the impact forces striking the object 209, but without any distortions or resonances that might otherwise have been introduced by the physical object 209 or the transducer 207. Deconvolution as a means of cancellation of the effect of transfer circuit on an input signal is well known per se, and is described for example in U.S. Pat. No. 5,185,805 issued to Chiang on Feb. 9, 1993 entitled "Tuned deconvolution digital filter for elimination of loudspeaker output blurring," the disclosure of which is incorporated herein by reference.

Other Expressive Controls and Extensions to Real-Time Convolution

Figure 3:
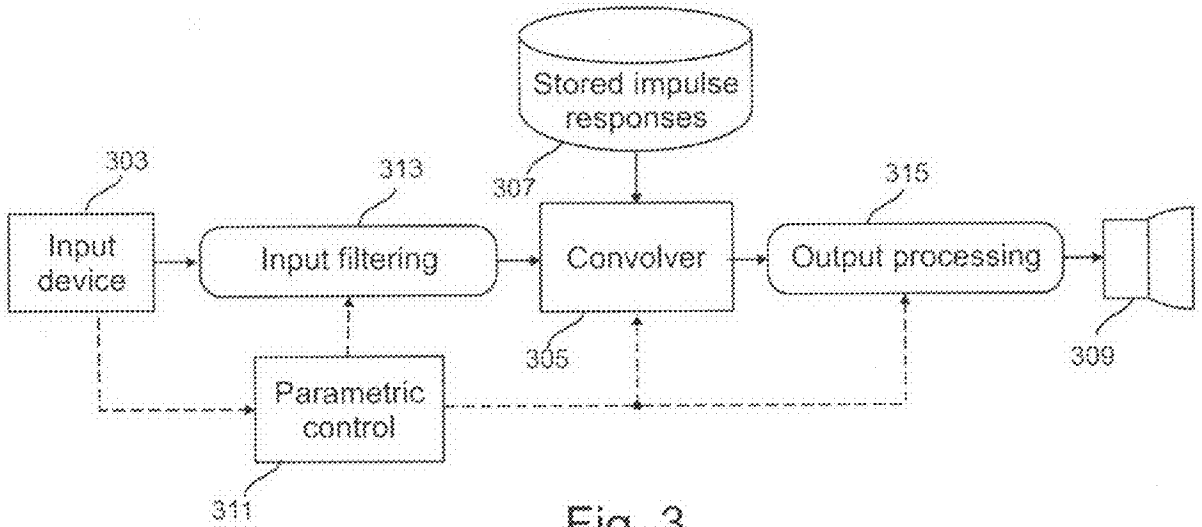
FIG. 3 is a schematic block diagram illustrating an electronic percussion synthesizer capable of synthesizing damped percussion sounds, crashed cymbals, and creating other effects.

A block diagram of the signal processing mechanism used to achieve special effects is illustrated in FIG. 3. An input device seen at 303 is used to capture the waveform produced when a performer strikes, scrapes or rubs a playing surface of an object by employing a sensor acoustically coupled to the object for producing a signal waveform representative of the forces impacting the object (as explained above in connection the mechanism seen at 207, 209 and 220 in FIG. 2). The waveform produced by the input device is convolved at 305 with a stored impulse response of the instrument to be synthesized which is pre-recorded and stored at 307. The output waveform produced by the convolver 305 is then fed to a sound system illustrated at 309.

In order to achieve special effects, control signals created by the performer using one or more control devices (depicted in FIG. 3 as part of the input device), such as a damping control that the performer can manually manipulate to vary the amount by which synthesized drum sounds are damped. As seen in FIG. 3, the control commands from the performer are converted by a parametric control device 311 into parameter values that are used to control how some or all of the following functions are performed:

(1) control the operation of an input filtering unit 313 which performs non-linear wave shaping on the audio signal produced by the audio object sensor before that signal is convolved with a stored impulse response at 305;

(2) control the parameters of the convolution performed by the convolver 305 to provide damping, crossfades, shifts in pitch, and non-linear chaining, as described in more detail below; and (3) control the manner in which output processing is performed at 315 wherein the signal produced by the convolver 305 is modified before it is delivered to the sound system.

Beyond varying the spectrum of the hits, players of real percussion instruments often have control over other features of the instrument including damping and pitch, which can play significant roles in the player's control of the sound and musical expression. Performing such modifications to the sound would ideally occur by changing the stored impulses. As noted above, a switching or mixing system may be used to switch between or convolve two or more different stored waveforms with the impact signal representing forces applied to the playing surface. For example, simple damping may be implemented by running two convolutions at once, one of a damped target sound, and the other for an undamped sound. A sensor detects if the player's hand is touching the playing surface and crossfades to the damped sound if it is. Thus, if the player hits the playing surface normally, it "rings" in accordance with the undamped waveform, or if the player hits and then holds the playing surface, the output sound is damped. As discussed in more detail below, however, when the impulse response data is partitioned into longer blocks of different sizes to achieve both computational efficiency and low latency, simply switching from one stored impulse to another is not an option.

Figure 4:
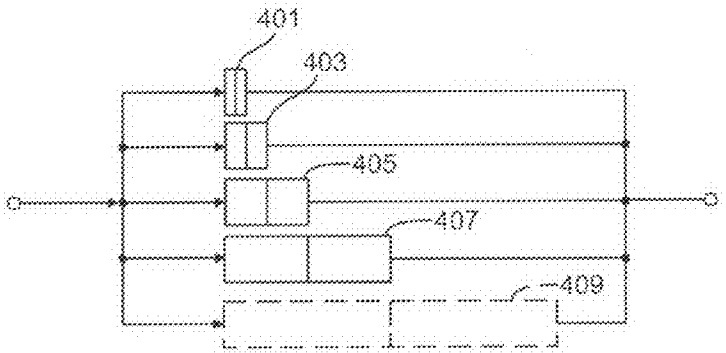
FIGS. 4 and 5 illustrate how samples of an instrument's impulse response may be subdivided into variable-sized partitions to achieve high speed convolution.
Figure 5:
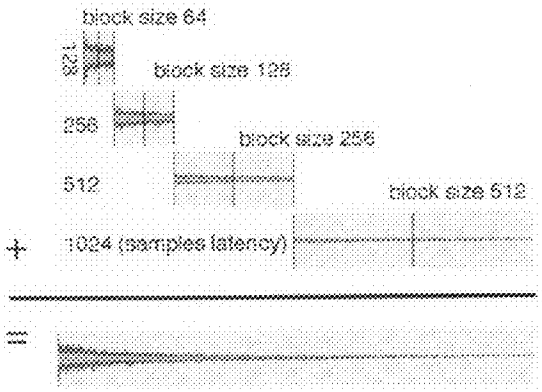

To minimize processing by the convolver 305, stored samples in the store 307 are preferably Fourier transformed at the time they are loaded. When a new stored impulse response file is loaded, it is placed in a buffer and subdivided into consecutive segments of increasing segment lengths. These segments are windowed (using a square window), Fast Fourier Transformed, and loaded into tables to be processed by the convolver 305. These segments are of increasing size to minimize latency as illustrated in FIG. 4, with each segment consisting of a number of samples equal to double the block size. For example, the first 128 samples are transformed as two blocks of 64 samples each as seen at 401, the following 256 samples are transformed with a block size of 128 samples as seen at 403, the following 512 samples with a block size of 256 as seen at 407, and so on, up to the maximum block size (typically 4096 samples) at which point the block size repeats until the end of the recording. Since each partition requires a real FFT (Fast Fourier Transform) and an IFFT (inverse Fast Fourier Transform), its total latency is twice its block size. By convolving two blocks of each size, for a single impulse, the shorter blocks finish playing exactly as the next-longer block begins playing as illustrated in FIG. 5, giving a seamless output. This does require adding a delay to the audio input going to the second block of each partition, and adding progressively longer delays before the same-sized partitions operating on the end of the recording.

In the convolver, each pair of convolution partitions has its audio block rate set independently This requires only one FFT/IFFT per convolution partition. New audio coming in from the physical interface is fed into all of the partitions, with additional delays for the repeated partitions.

Damping

One very important property of real percussion instruments is that they can be damped. The player can press on the drumhead or grab a cymbal and the sound will decay more quickly. In physical systems, energy losses can occur internally or in transfer to a part external to the system. Viscous losses (such as air resistance) are proportional to velocity, such as seen in a dashpot, yielding an exponential decay. However, other damping mechanisms do not behave as exponentials. For example, internal friction in a non-viscous material provides a constant force opposing the direction of movement, but independent of velocity, resulting in a linear decay. This is referred to as hysteretic, or coulombic damping. The observed decay for any system is the sum of all of the damping mechanisms. In percussion instruments, viscous damping tends to predominate at the attack and early decay due to higher velocities, while hysteretic damping dominates the tail. If a player further damps the system by resting a hand on it, the hand acts as an additional damper, increasing the rate of decay of the system.

Simple Damping Model

In the convolution percussion system contemplated by the present invention, it would be desirable to give the player the ability to damp the sound in the same manner as with an acoustic instrument. Ideally, before it is convolved with the sensed playing signal, the stored impulse could be multiplied by a known function that yields a decay curve that is similar to that of the damped instrument, for example a function that provides an exponential decay. By superimposing a new decay curve on the original signal, a new apparent degree of damping can be obtained.

Note that the sampled impulse responses already exhibit approximately exponential decay (except for the very end of the sample where there is usually a linear fade out to zero). This is both because of hysteretic damping in the object, which is more prominent at lower amplitudes, and because a linear fade out is often necessary when editing the audio samples to keep their duration reasonably short. To produce an output sound as if the damping coefficient of the real instrument were higher, one can multiply the recording by another exponential.

Unfortunately, in order to achieve efficient signal processing, the convolution works by storing the FD representation of the various impulse partitions to avoid having to recalculate them as discussed above in conjunction with FIGS. 3 and 4. Any operations performed on the stored impulse in the time domain would require an additional FD transform. In addition, any changes to the impulse would require at least one block of latency for the forward and inverse FD transforms before they were heard by the player. This presents a problem: multiplying two time domain signals is equivalent to convolution in the frequency domain. For large signals this is not computationally tractable.

One solution is to control the gain of each block at its output, so the early sounds are louder than the later ones. Recall that the system uses variable-size convolution partitions to limit the overall system latency. The block gains can be set to approximate any function, but since the gains are constant within each block, the output takes on a stairstep shape, shown in FIG. 6.

Calculating Block Gains

Figure 6:
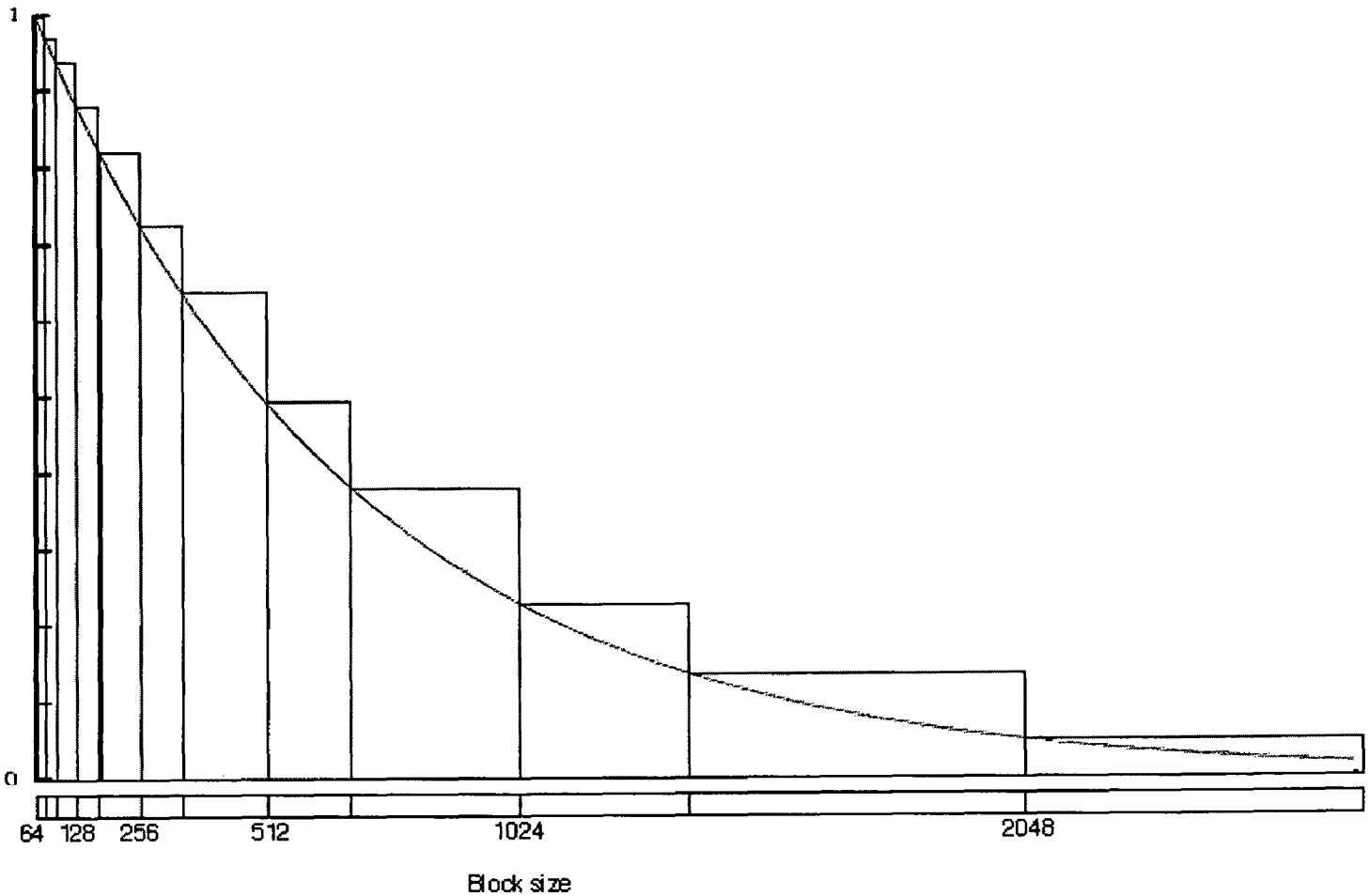
FIG. 6 shows how the output gain may be progressively decreased from partition to partition to synthesize a damped percussion instrument.

The convolution blocks start out with two 64-sample blocks, two 128-sample blocks, etc., as shown at the base in FIG. 6. The sample location t relative to the start of the impulse response recording is given by the sum of the previous blocks: 2(64)+2(128)+2(256)+2(512)+2(1024) . . . , or 128+256+512+1024+2048 . . . , the sum of a geometric series, also give $$a + ar + ar^2 + ar^3 + \ldots + ar^{n-1} = \sum_{k=1}^{n} ar^{k-1} = \frac{a(1-r^n)}{1-r} \quad \text{Equation}$$

in this case r=2, a=128 so $$t = \frac{128(1-2^n)}{1-2} = 128(2^n - 1)$$

The exponential decay we would-like:

$$y(t)=e^{-\lambda t}$$

expressed in terms of n is therefore $$y(n)=e^{-128(2n-1)\lambda}.$$

Transitions between the block gains can introduce artifact, but is usually not audible, and using a Hanning window instead of a square window can remove that artifact, but also increases the computational requirements. The steady state response can then be made to approximate any desired-decay curve.

Dynamic Continuity Problems

Controlling the gains of each block gives a realistic-sounding damping at steady state, but changing the damping abruptly causes an abrupt change from one level (due to a first damping effect) to another level to which the sound would have decayed with a different damping. However, by cross fading between the two curves (that is, by increasing the contribution from the second curve over time while decreasing the contribution of the second), the discontinuities due to switching damping coefficients can be minimized. Neither the linear nor the quadratic cross fade are very good fits, but the main goal is to minimize transients during the transition. For all subsequent hits, the actual decay curve will match the target curve.

A Second Dynamic Problem: Undamping

While using the above method to control the gain of the output of each convolution partition results in an immediate change in the decay curve, it exhibits quite unrealistic behavior when undamping.

Striking a real cymbal while holding on to it will result in a short decay. Let go of the cymbal, and it will continue to decay with its previous un-choked time constant. In a virtual cymbal in which only the output gains are controlled, if the player releases the cymbal before it is completely decayed, the level jumps back to the previous decay curve, creating an unnatural echo. If there are additional hits that happen while the system is damped, when the player releases, the output jumps to the accumulated volume of those hits, just as if the system had never been damped to begin with.

One partial solution is to decrease the gain of each convolution partition at its input as well as at its output. This would completely eliminate the echo as long as the damping is held for the duration twice as long as the longest partition, typically 4096 samples (93 ms). Any changes made to the gain at the beginning of the partition (say at time t1) won't be heard until the convolved result emerges from the partition at time t1+δ.

Let:

$G_i$=partition input gain $G_o$=partition output gain $G_t$=desired total gain

To achieve a total gain Gt at steady state:

$$G_i, G_o = \sqrt{G_t}$$

One advantage is that the longest partitions processing the end of the impulse also are already at the lowest volumes, minimizing the significance of any artifact. However, only the effect of changing the output gain is perceived immediately, while the change in the input gain becomes audible one partition size later. Even though both the input and output gains are reduced immediately, the latency due to the FD transform delays the perception of changes to the input gain. This actually causes the overall gain of the partition to go through two different reductions if both reductions are non-zero.

Figure 7:
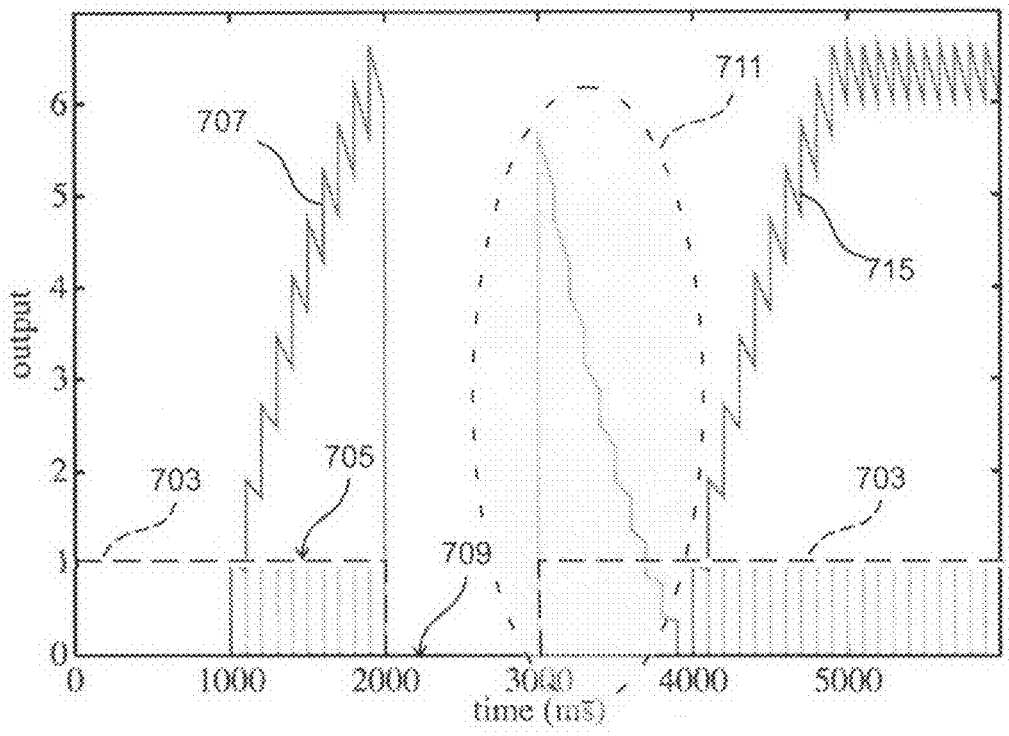
FIG. 7 illustrates the output waveshape produced when an attempt is made to mute the output waveshape for a duration less than the partition size.

One problem with using the same input and output gains comes when the system is muted for less than the sum of partition size plus the length of the stored sample in that partition (usually occupying the whole partition). Consider only one partition with a latency of 1,000 ms that is receiving 10 strikes per second starting at t=0 (FIG. 7). The output gain is shown plotted in a dashed line at 703, and is either 1 or 0 for the sake of simplicity. We first hear output at t=1,000 ms. If the sample is very short, it tracks the output gain times the delayed input gain as seen at 705. But if it is longer, it slowly builds up as seen at 707, matching the behavior of real instruments. When the system is muted, output goes to zero as expected as seen at 709, but if it is un-muted before two partitions have elapsed, the output jumps to the level that is still decaying inside the convolver as seen at 711. After that short burst, it behaves properly again, slowly building up as seen at 715.

We do better if we set the partition output gain $G_o$ to be the minimum of the target gain $G_t$ and the input gain $G_i$; however, there is still artifact if the duration of muting is less than ½ of the partition duration. This problem can be solved by making $G_o$ equal to the minimum value of $G_i$ over the duration of the partition:

$$G_o(t) = \min_{t-\delta \le \tau \le t} G_i(\tau)$$

However, this solution reveals another problem. When the inputs are below the partition frequency, the output does not build up, since the result of each hit stops playing before the next hit occurs. If the hits are above the partition frequency, the outputs do accumulate. At both input frequencies, there is a step artifact due to the lag in changes to the input gain propagating through to the output. This lag is equal to the partition duration.

For infrequent (less than the partition frequency) inputs, this artifact can be removed by setting the output gain to be equal to the minimum of the input gain (over the duration of the partition) divided by the delayed input gain:

$$G_o(t) = \frac{\min_{t-\delta \le \tau \le t} G_i(\tau)}{G_i(t-\delta)}$$

A problem does occur with more frequent hits. For example, when hitting clearly with a stick, no serious artifacts occur when damping and undamping, but stirring with brushes while changing damping created a series of pulses. This intermittent artifact is caused by the accumulation that occurs because the period between hits is shorter with frequent hits than the duration of the stored impulse. Although the artifact is completely removed for infrequent hits, the new artifact generated for frequent hits is much more objectionable due to its spike shape and sharp transitions which cause audible clicks. The artifact created when $G_o$ is made equal to the minimum value of $G_i$ over the duration of the partition is not readily apparent, and is mitigated by slowing down the rate of change of muting. If it is rate of change of muting slowed to the partition duration or slower, it disappears completely.

Frequency-Dependent Damping

The muting mechanisms by controlling partition gain described above act equally on all frequencies. However, viscous damping acts more strongly at higher frequencies, so we would like to implement a faster decrease in high frequencies than in low ones.

Although losses in real materials occur through a variety of complex mechanisms, they can be approximated as the sum of viscous and frequency-independent losses. As in the case of frequency-independent muting, latency and block size are still going to introduce some artifact, and although the ideal steady state solution would be to alter the recorded impulse, the latencies involved in changing the filter are again too long to give a convincing result.

In viscous damping, any particular sinusoid will decay as an exponential, and at any particular time, the rates of decay will increase exponentially as a function of frequency such that sinusoid gain may be expressed as:

$$\propto e^{-\lambda_f t}$$

For ease of calculation, the exponential frequency curve will be approximated using a one-pole filter by matching their −3 dB points. For the exponential $$y = e^{-\lambda_f}$$

the −3 dB point is half the power, $1/\sqrt{2}$. The equivalent cutoff frequency is:

$$f_0 = \frac{\ln\left(\frac{1}{\sqrt{2}}\right)}{-\lambda}.$$

Minimizing Artifact when Changing the Damping Values

As in the case of frequency-independent muting, changes to the filter cutoff at the input to each partition take one partition length to be heard. Similarly, we can temporarily apply another filter at the output, and set its cutoff to be the minimum value of the input filter cutoff over the duration of the partition ($t-\delta \leqq \tau \leqq t$) so that:

$$F_o(t) = \min_{t-\delta \leq \tau \leq t} F_i(\tau)$$

The amounts of frequency-dependent and frequency-independent damping can be controlled independently, enabling the player to dial in a particular default decay profile, and also control the effect of choke and pressure sensors (described below) to allow for intermittent, expressive damping. For a stored impulse response like a cymbal, increasing the frequency-independent damping results in a dryer sound, more like a change in the properties of the cymbal itself, while increasing the frequency-dependent damping sounds as if the player was applying a manual choke.

Both systems can also be used to provide progressively larger boosts as the stored impulse decays, giving much brighter or simply extended decays relative to the original recording. Similarly, crude multi-tap and tremolo effects are also possible simply by controlling the partition gains.

Pitch Shifting

Some drums, such as timpani and many hand drums, allow for changes in the tuning of the head. Since we only have a sample impulse response of the instrument to start with, and not a physical model, it is not possible to simply vary model parameters to gain the new pitch. Further complicating matters is that, unlike in a digital sampler with which a sample can be played out slower or faster to achieve tape-style pitch shifting, we are limited to partitions that have a fixed duration. Slowing down or speeding up the playback of a partition, or stretching its spectrum will result in gaps or discontinuities at the partition boundaries. Shifting the partitions in time to accommodate and conceal these gaps would also require an additional partition's length of latency. Using Hanning or raised cosine windows instead of square windows hides the gaps, but at the expense of doubling the computation.

One advantage of working with percussion sounds is that they are largely non-harmonic, which allows the use of spectrum shifting to achieve changes in pitch. The chief advantage of this method is that the timing remains constant while the pitch changes. The primary disadvantage is that the spectrum is shifted by a fixed number of Hz, so the ratios of frequencies do not sound constant. For example, a plucked string has overtones that are multiples of its fundamental. Shifting the string spectrum will cause those overtones to no longer be multiples of the fundamental, giving a more metallic, non-harmonic sound. Luckily, many percussion sounds lend themselves to this kind of manipulation due to their lack of aligned harmonics.

Due to efficiency constraints, spectrum shifting is the preferred method to achieve changes in pitch. Since this is operating on the stored FD representations of the impulse response, there is still some latency (half of a partition length) to hear the pitch change effect. For very fast pitch changes, this is an audible artifact. Limiting the rate of pitch change and limiting the maximum partition size helps control this artifact. Shifting the spectrum of the input instead of the stored sample has little impact on the output sound for relatively broad band inputs, but could be useful for limiting audio feedback.

A second approach is to perform the pitch shifting on the output only. For this purpose, any of the established pitch shifting algorithms can be applied, with the usual tradeoffs of latency, jitter, and artifact.

Cross Fading

To perform cross fades, the most straightforward method is to literally cross-fade the pre-transformed stored impulse with another. This works for very slow fades, but as with damping and pitch shifting, it does not work for faster manipulations. There are several other options, all have their advantages and disadvantages. In the below examples, the case of two convolvers is considered for clarity, though the same advantages and disadvantages apply for more than two convolvers.

Parallel—gain set at outputs. In this method, two convolvers are running, and there is a simple cross fade of their outputs. The effect is one of switching between listening to two different instruments that are ringing down differently. Unless the sounds are very similar, there is not fusion into one instrument.

Parallel—gain set at inputs. This method gives each convolver time to ring down when the input is switched to the other. This primarily gives the impression that the player is switching between playing two instruments, or two distinct parts of one instrument.

Figure 8:
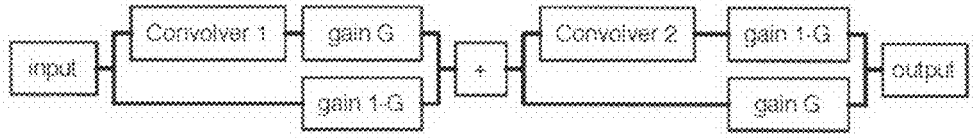
FIG. 8 is a schematic diagram illustrating how two convolvers may be operated in sequence.

Series. Connecting two convolvers in series raises additional challenges for where the control should occur. One option is to leave the first convolver on all the time, and control how much signal goes through the second convolver, either by controlling its input, output, or both. When both are engaged, only frequencies in common to the input and both stored impulses will pass through. For full cross fading between convolvers, something like the system in FIG. 8 is required. When G is around 0.5, both convolvers are active, and frequencies in common are boosted, but also some signal is still allowed to bypass each convolver;

Nonlinear Responses

One weakness of the technique of using impulse responses to represent physical systems is that it does not properly account for nonlinearities. Some percussion instruments such as cymbals and gongs have significant nonlinear responses that are amplitude-dependent, resulting in their rich spectrum. Because of their complex behavior, cymbals and gongs are also particularly hard to model.

For gongs, the modal frequencies can shift with amplitude, with as much as 20 percent frequency variation as the sound decays. When driven with a fixed tone, gongs will develop subharmonics and overtones as the displacement increases.

According to most drummers, the term "ride" means to ride with the music as it sustains after it is struck, and the term can refer to either the function of the cymbal in the kit or to the characteristics of the cymbal itself. When struck, a ride cymbal makes a sustained, shimmering sound rather than the shorter, decaying sound of a crash cymbal. A crash cymbal produces a loud, sharp "crash" and is used mainly for occasional accents.

When driven sinusoidally, cymbals exhibit three distinct modes of operation: at low amplitudes, harmonics of the driving frequency develop, with greater amplitude as the driving sign increases. At medium amplitudes, subharmonics develop, filling in the spectrum, yielding a non-harmonic sound. At high levels, they cymbal exhibits chaotic behavior, with a very complex spectrum. This accounts for why crashing a cymbal sounds different from a louder ride sound.

If one were to send a louder impulse through the convolver, it would have no effect on the spectrum, but would just result in a louder output. If one convolves with a single cymbal sample in which the first part is in the chaotic regime, decaying to the subharmonic, and finally harmonic regimes, all output will be in those same regimes, following the same time profile of the stored sample, regardless of hit intensity.

To make a convincing crash cymbal, two convolutions can be performed, one of a standard ride hit, and the other of a crash. The second convolution for the crash is performed only if the amplitude of the driving signal is above a set threshold.

The use of more than one convolution permits more accurate replication of the sound emitted by instruments which exhibit nonlinear transitions between regimes. While convolution can emulate the response within a particular regime, the transitions are problematic. For example, playing a real ride cymbal with progressively louder hits will bring out more dense harmonics as the total output increases. With the convolution system and a single ride cymbal sample, there is no way to obtain modes other than what was already in that recorded sample. To address this problem, some knowledge of the real system is required, and each solution will have to be customized for a particular application.

Figure 9:
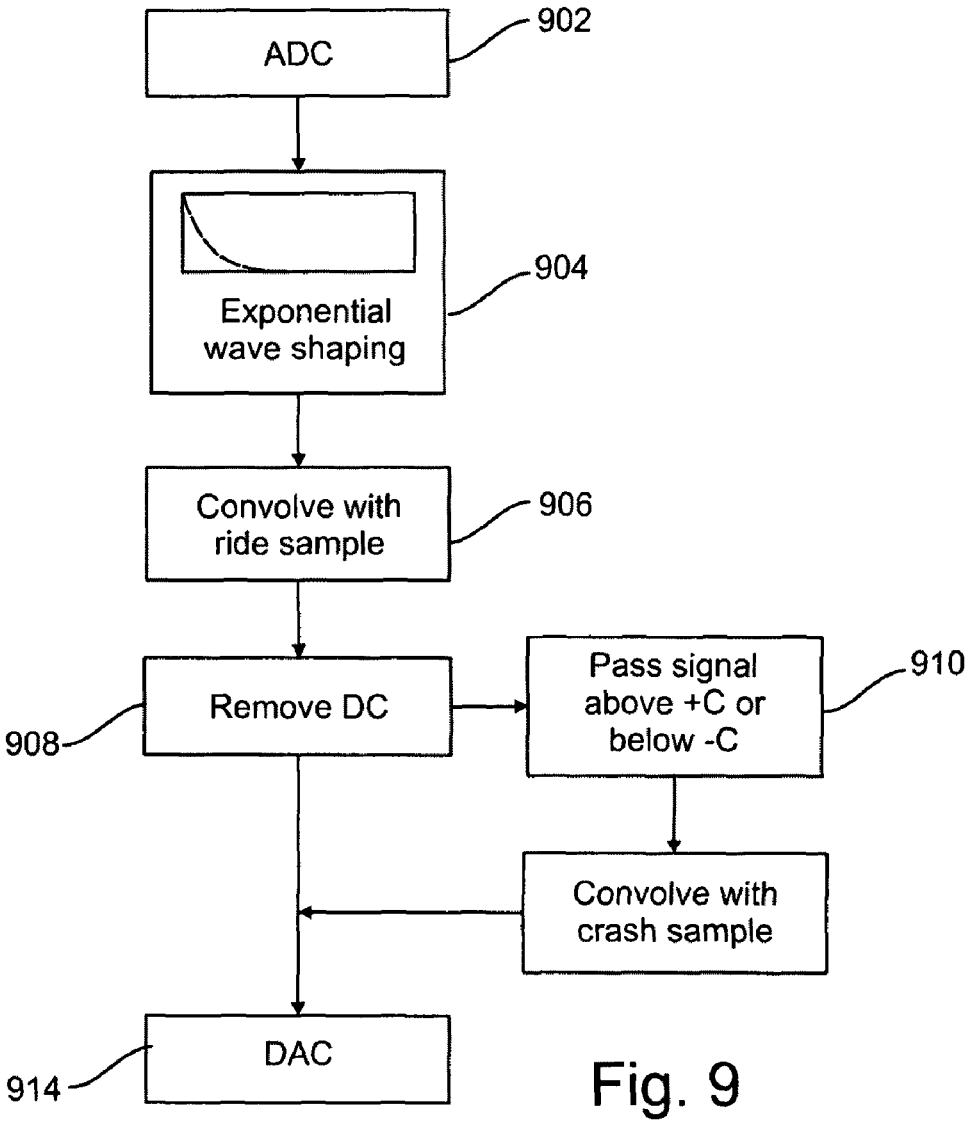
FIG. 9 is a flow chart illustrating a mechanism for synthesizing a cymbal crash by using two convolutions performed simultaneously.

To approximate the cymbal crash, two convolutions may be performed simultaneously. As seen in FIG. 9, in one example embodiment, sound from the taps is converted to a digital signal by an analog-to-digital converter (ADC) 902 which is waveshaped by an exponential function or other nonlinear filter to increase its harmonic content with increasing amplitude as seen at 904. The waveshaped signal is then convolved with a ride cymbal sample as indicated at 906. The DC content is then removed from the output from the first convolution at 908 and signals above or below the clipping thresholds +C and −C are passed at 910 and convolved at 912 with a sample of a cymbal being crashed. The result is then recombined the removed DC content and passed to a digital-to-analog converter (DAC) 914 which produces the desired crashed cymbal sound, with increasing frequency content with increasing hit intensity.

Physical Controllers

Because of the nature of the processing, both the signal processing methods (described above) and the physical part of the instrument (described below) are important. In the description below, the physical part of the instrument will be referred to as a "controller" although its acoustic properties and conception differ from typical MIDI controllers. These controllers exploit the fact that the convolver is acting as a resonator. By varying the degree of damping, physical resonances can be progressively removed and replaced with any desired resonance.

The controllers described in this chapter differ from one another in the degree to which their own acoustics influences the output. At one extreme, a practice pad controller is highly damped, and although it does impart a "plastic" sound, it is a minor coloration. In the middle, brush controllers give a clear impression that the stored impulse is being performed with a brush, taking on the dense time texture of the metal tines. At the other extreme, the cymbal controller provides significant coloration to any sound, enough so that it can sound like a cymbal bolted to a bass drum, or a cymbal attached to a snare. When convolved with bass drum or snare samples.

Cymbal

A cymbal controller can be constructed from an inexpensive real brass student cymbal, and it is designed to accommodate normal cymbal playing gestures such as hitting the bell or shell and choking the cymbal by grabbing its periphery. Since the cymbal controller is built around a modified real cymbal, it can sit on a standard cymbal stand.

Figure 10:
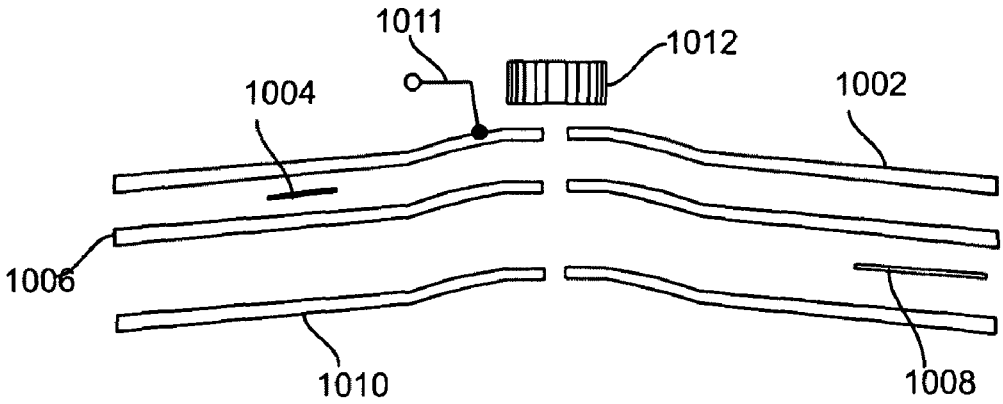
FIG. 10 is an exploded cross-sectional view of a cymbal that incorporates sensors for detecting impacts as well as touch-pressure applied by the performer to control damping.

As seen in FIG. 10, in one example, the cymbal controller is assembled in layers, from top to bottom:

(1) A real brass cymbal 1002;

(2) a PVDF sensing element 1004 bonded to the underside of the cymbal 1002, away from the playing area;

(3) A thin foam layer 1006 to damp the cymbal and transfer choke force;

(4) a force sensing resistor (FSR) 1008 for detecting an applied choke force at edge of the playing surface; and (5) a molded plastic cymbal substrate 1010 to support the assembly and further damp vibrations.

The edges of the assembly are sealed with silicone caulk. The FSR is connected directly to a computer audio interface that sends an audio output signal through the FSR and measures change in the signal levels emitted by the FSR to determine the sensor's resistance. The signals applied to the FSR are preferably in the 150-500 Hz range to minimize capacitive coupling while maintaining sufficient time resolution for controlling the damping. The PVDF sensing element 1004 is constructed from polyvinylidene fluoride which exhibits piezoelectricity several times larger than quartz.

Since there is significant spectral contribution from the cymbal, hits on the bell, rim, or edge sound substantially different from each other. Although multiple contact microphones could be employed to obtain the desired variation from hits in different locations, one microphone is sufficient because of the range of sounds achievable by hitting different parts of the cymbal. When convolving with a cymbal sound, the effect is that the lost resonance of the cymbal (due to damping) is restored. One drawback to allowing the controller to provide more of the spectrum is that while it heightens the realism of cymbal sounds, it will always impart a cymbal-like quality, even to non-cymbal sounds. For example, when convolved with a concert bass drum sound, the output sounds as if a cymbal was somehow joined to the drum head.

In addition to the FSR circuit, the surface of the cymbal may be electrically connected to an audio interface as indicated at 1011 to pick up the 60 Hz hum produced when the performer touches the surface of cymbal 1002. The envelope of the hum signal may be used to control damping. Even though it provided essentially only one bit of data, having the cymbal be sensitive to damping over its entire surface proved to be more important than having a range of damping in one location.

A potentiometer knob 1012 is positioned at the top of the cymbal as seen at 1012. The knob-controlled potentiometer resistance may be measured in the same way that the resistance of the FSR 1008 and allows the performer to dial in a particular cymbal sound from the cymbal itself.

Brushes

Instead of placing the sensor on an object which is struck, rubbed or brushed, the sensor may be placed on the drumstick, mallet, brush or other implement used to strike the object. For example, a conventional brush may be fitted with a PVDF contact microphone to pick up the sound in the metal tines. Any surface can be played with the brushes, and the resulting output sounds as if the sampled instrument is being played with brushes, but has the texture of the surface being played. By stirring the brush on a surface, a sustained broad band noise can be produced that results in quite different timbres than were observed with the pads or cymbal controller. Different combinations of surface textures, brush movements and stored impulse are possible. A wireless brush may be constructed using the same circuitry employed in a handheld microphone which includes a small radio transmitter for transmitting its audio signal. Several wireless brushes can be used simultaneously using different VHF channels. Alternatively, the brushes may be tethered to an audio input interface by a multiconductor cable.

Pad

A simple controller can be constructed from a conventional drum practice pad. Since one of the goals of a practice pad is to be quiet, it was already well damped. A piece of PVDF foil may be applied under a layer of foam located beneath the drumhead and above the plastic shell in a manner similar to that used in the cymbal of FIG. 10, with the PVDF sensor connected directly to the audio interface. The pad proved a surprisingly versatile controller, working well with most impulses.

Frame Drum

The same technique of using the acoustic response of the physical object can be applied to the construction of a drum controller. In this arrangement, contact microphones, damping material, and pressure sensors are attached to a conventional wooden frame drum which is much less damped than the practice pad, ensuring that more of the spectrum of the drum was carried through the processing. Drums struck in different locations can excite different modal structures. For example, striking location helps create the differences between Djembe bass, tone, and slap sounds. Unfortunately, the convolution system is limited to one set of modes that are in the sampled sound. One way around this problem is to run multiple convolutions at once, and to have contact microphones at multiple locations on the drum head. Alternatively, the location of the hit may be tracked using multiple contact microphones and the sensed location used control a cross fade so that hits on the center and edges of the drum are processed differently.

An FSR mounted at the center of the drum responds to pressing anywhere on the drumhead (although much more strongly at the center) and its output signal gives good subtle control of damping by pushing at the edges, while still allowing sudden and immediate damping by pushing at the center. Pushing on the drum head also raises the pitch of the drum slightly. Although a small pitch change can be controlled by a second pressure sensor, for many drum sounds there is enough of a pitch effect due to the changes in tension in the real drum head, even though the stored impulse is not shifted. Separate processing of the rim signals from the center works particularly well for Djembe sounds. Since there is an increase in low frequency output of the center PVDF sensor when it is hit directly, it was found that Djembe bass and tone sounds could be combined into one sample, obtaining more of one or the other entirely based on where and how the drum was hit, while using the edge sensor just for Djembe slap sounds.

Bass Drum with Speaker

It is often desirable to have the synthesized sound emit from the object rather than from speakers in other locations. This provides a stronger illusion that the player is interacting with a physical object rather than a computer. To achieve this, a bass drum shell can be used as a speaker cabinet wherein the speaker is located behind the drum head. This provided both a sonic and tactile feedback to the player. The drum head can be made of mesh or similar materials that allow the sound of the speaker to pass through the head with minimal acoustic coupling to the head. The resulting bass drum controller, because of its appearance, loud output, and low bass extension, was well suited for the obvious role of large drum sounds, along with thunder, prepared piano soundboard, as well as for large gongs and cymbals. Due to the resonance in the physical structure, some equalization was necessary to control feedback, making it an ideal candidate for using deconvolution to pre-filter a typical hit from the stored impulses. The base drum controller with speaker also was well-suited for snare drum sounds, provided that the head is given a high enough tension to provide proper stick bounce.

Other Controller Implementations

Several different controller designs have been presented above as illustrations of the underlying design methodology. A fundamental trade-off must be considered in the design of each controller. For the output to sound exactly like the stored sample, the input performance signal should comprise perfect impulses with no timbral contribution from the physical controller; However, to obtain sufficient variation in the timbre, the acoustic contribution of the controller has to be significant. Moreover, the placement and design of the secondary controls such as pressure, bend, and touch sensors not only have to be consistent with the use of the instrument, but have to allow the controller to function as an acoustic object.

The specific controllers described above greatly in how their own acoustics influence the final sound. For the bass drum and pad, where that influence was regarded to be a potential liability, the range of timbres was small, and the typical timbre had strong resonances requiring work through equalization and filtering to mitigate its impact. For the frame drum and cymbal, it was possible for the player to extract a much broader variation of timbre, giving an extra element of realism and variation to the final output.

Conclusion

The principles of the present invention may be applied to advantage to improving the performance and fidelity of a variety of instruments and musical systems, including electronic drum kits, hand percussion instruments for producing synthetic sounds, assorted auxiliary percussion devices, or to systems that connect to existing instruments or other objects of the player's choosing, including clip-on transducers that connect to an acoustic drum set. The system may be used in non-musical applications, permitting interaction with the apparent acoustic properties of almost any object. The system may be used to represent hidden states of objects, convey low-priority information, and provide another degree of freedom for designers to explore the apparent quality of materials. It is to be understood that the methods and apparatus which have been described above are merely illustrative applications of the principles of the invention. Numerous modifications to the disclosed methods and apparatus may be made by those skilled in the art without departing from the true spirit and scope of the invention.

What is claimed is:

1. An electronic percussion instrument for simulating the sound, behavior, or both of a specific instrument, said specific instrument comprising an existing or idealized acoustic instrument or a synthetic instrument, said electronic percussion instrument comprising, in combination, a memory device for storing a first signal waveform representative of the sound produced by said specific instrument when subjected to an actual or simulated momentary impact, an object defining a playing surface, a sensor for producing a second signal waveform representative of the vibration produced when said playing surface is struck, scraped or rubbed by a human player, a control interface for accepting one or more control signals, a signal processor for convolving representations of said first signal waveform and said second signal waveform to produce an output waveform and for varying said output waveform in response to said control signal, and an output sound system coupled to said signal processor for utilizing said output waveform.

2. An electronic percussion instrument forth in claim 1 wherein said first signal waveform and said second signal waveform are each represented by a sequence of digital values, wherein said memory device stores one or more frequency domain representations of said first signal waveform, and wherein said signal processor performs frequency domain multiply operations to convolve said first signal waveform and said second signal waveform.

3. An electronic percussion instrument as set forth in claim 1 wherein said memory device further stores a third or more signal waveforms representative of the sound produced by said specific instrument under different conditions or by a different instrument and wherein said signal processor further convolves said third or more signal waveforms with said output waveform to produce a modified output signal that is supplied to said output sound system.

4. An electronic percussion instrument as set forth in claim 3 wherein said first signal waveform is representative of the sound produced by a ride cymbal and wherein said third signal waveform is representative of the sound produced by a crash cymbal impacted with a crash hit.

5. An electronic percussion instrument as set forth in claim 4 further including a nonlinear filter for modifying said output waveform before said signal processor further convolves said third or more signal waveforms with said output waveform.

6. An electronic percussion instrument as set forth in claim 3 wherein the relative contribution of each of said third or more waveforms to the output signal is controlled by said human player.

7. An electronic percussion instrument as set forth in claim 1 wherein said sensor is acoustically coupled to a hand-held implement to produce said second waveform when said playing surface is struck, scraped or rubbed by said human player using said hand-held implement.

8. An electronic percussion instrument as set forth in claim 7 wherein said hand-held implement is a brush, drumstick, or mallet.

9. An electronic percussion instrument as set forth in claim 1 wherein said output sound system includes a loudspeaker mounted within said object.

10. An electronic percussion instrument as set forth in claim 9 wherein said playing surface is a mesh material.

11. An electronic percussion instrument as set forth in claim 1 wherein said playing surface is the surface of a real percussion instrument that has been physically damped.

12. An electronic percussion instrument as set forth in claim 1 wherein said signal processor modifies the rate of decay manifested by said output waveform to simulate a damped instrument.

13. An electronic percussion instrument as set forth in claim 12 wherein said control interface is responsive to one or more manual controls manipulatable by said human to vary said control signal.

14. An electronic percussion instrument as set forth in claim 13 wherein said manual controls include one or more sensors for varying said control signal when said playing surface is touched.

15. An electronic percussion instrument as set forth in claim 14 wherein said control signal includes a binary indication of whether or not said playing surface is being touched.

16. An electronic percussion instrument as set forth in claim 14 wherein said control signal varies continuously to indicate the amount by which said playing surface is being touched.

17. An electronic percussion instrument as set forth in claim 12 further including means for subdividing at least a portion of said first digital waveform into consecutive segments and storing a frequency domain representation of each of said segments in said memory device and means for producing a frequency domain representation of said second signal waveform, wherein said signal processor multiplies said frequency domain representation of each of said segments and said frequency domain representation of said second waveform to form product data, and transforms said product data into the time domain to produce said output waveform.

18. An electronic percussion instrument as set forth in claim 17 wherein said signal processor separately modifies each of said segments in response to said control signal.

19. An electronic percussion instrument as set forth in claim 18 wherein said signal processor modifies each of said segments in different ways.

20. An electronic percussion instrument as set forth in claim 18 wherein said signal processor filters each of said segments to alter its spectral content.

21. An electronic percussion instrument as set forth in claim 1 wherein said signal processor varies the pitch of said output waveform.

22. An electronic percussion instrument as set forth in claim 21 wherein said control interface is responsive to one or more manual controls manipulatable by said human to vary said control signal to alter the pitch of said output waveform.

23. An electronic percussion instrument as set forth in claim 22 wherein one or more of said manual controls is positioned on or near said playing surface at a location accessible by said human.

24. An electronic percussion instrument as set forth in claim 21 wherein said signal processor rotates the spectrum of said first signal waveform, said second signal waveform or said output waveform in the frequency domain to alter the pitch of said output waveform.

25. An electronic percussion instrument as set forth in claim 21 wherein said signal processor stretches the spectrum of said first signal waveform, said second signal waveform or said output waveform in the frequency or time domain to alter the pitch of said output waveform.

26. An electronic percussion instrument as set forth in claim 21 wherein said signal processor alters the spectrum of said first signal waveform, said second signal waveform or said output waveform in the time domain to alter the pitch of said output waveform.

27. An electronic percussion instrument as set forth in claim 1 wherein said second waveform is pitch-shifted to avoid acoustic feedback.

28. The method of simulating the behavior of a real, idealized, or synthetic percussion instrument comprising, in combination, the steps of:

storing a first signal waveform representative of the sound produced by said percussion instrument when said idealized percussion instrument is caused to sound, employing a sensor acoustically coupled to a playing surface to produce a second signal waveform representative of the vibration of said playing surface when struck, scraped or rubbed by a human player, convolving representations of said first signal waveform and said second signal waveform to produce an output waveform, producing a control signal indicative of a desired audio effect, and employing a signal processor to modify in the frequency or time domain the spectral components of said output waveform in response to said control signal to produce a modified output waveform which manifests said desired audio effect.

29. The method of simulating set forth in claim 28 wherein said signal processor modifies the amount of energy in one or more of said spectral components.

30. The method of simulating set forth in claim 28 wherein said signal processor reduces the amount of energy in one or more spectral components of said output waveform that correspond to spectral components that contain substantial energy content in both said first signal waveform and said second signal waveform.

31. The method of simulating set forth in claim 28 wherein said step of employing a signal processor to modify in the frequency or time domain the spectral components of said output waveform modifies said first signal waveform before said step of convolving is performed.

32. The method of simulating set forth in claim 28 wherein said step of employing a signal processor to modify in the frequency or time domain the spectral components of said output waveform modifies said second signal waveform before said step of convolving is performed.

33. The method of simulating set forth in claim 28 wherein said step of employing a signal processor to modify in the frequency or the time domain the spectral components of said output waveform modifies said output waveform after said step of convolving is performed.

34. The method of simulating set forth in claim 28 wherein said step of producing a control signal indicative of a desired audio effect includes the step of employing one or more manual controls operable by said human player to vary said control signal.

* * * * *